United States Patent [19]

Keith

[11] Patent Number: 4,860,888

[45] Date of Patent: Aug. 29, 1989

[54] SHIPPING AND HANDLING CONTAINER FOR TWO PART COMPOSITION

[75] Inventor: Roger H. Keith, Austin, Tex.

[73] Assignee: Minnesota Mining and Manufacturing Company, St. Paul, Minn.

[21] Appl. No.: 212,901

[22] Filed: Jun. 29, 1988

[51] Int. Cl.[4] ..... B65D 69/00

[52] U.S. Cl. ..... 206/223; 206/431; 206/568; 206/459

[58] Field of Search ..... 206/223, 427, 429, 431, 206/568, 602, 459

[56] References Cited

U.S. PATENT DOCUMENTS 2,819,793 1/1958 Lamb ..... 206/431

3,384,229 5/1968 Kaschyk et al. ..... 206/431

4,213,529 7/1980 Whitaker ..... 206/602 X 4,591,090 5/1986 Collins ..... 229/120.36

*Primary Examiner*—Allen M. Ostrager

*Attorney, Agent, or Firm*—Donald M. Sell; Walter N. Kirn; John C. Barnes

[57] ABSTRACT

A shipping carton for containers having gabletops, wherein it is desired to maintain the containers in pairs, is provided with areas which receive the containers in pairs and support members are provided to support the gable tops from one side of the carton and identify the pairs of containers and separate them from other pairs of containers. The support members bridge the areas and are doubly deeply grooved to engage the gabletop containers.

11 Claims, 2 Drawing Sheets

SHIPPING AND HANDLING CONTAINER FOR TWO PART COMPOSITION

BACKGROUND OF THE INVENTION

1. Field of the Invention

This invention relates to an improved shipping and handling carton for a composition that is contained in two separate containers and more particularity to a compartmented box for nesting pairs of said containers and in one aspect to a carton for pairs of gabletopped cardboard containers.

2. Description of the Prior Art

Prior to the present invention it has been customary to supply two part compositions for use in filling telecommunication splice closures in separate primary containers such as cans, two compartment plastic bags, tubes, or bottles. These containers were shipped in the conventional corrugated pasteboard box with honeycomb dividers between the individual containers to avoid rupture or the noise associated with contact between containers.

The prior art has not addressed the problem of packaging paired containers except separately in a shipping container with normal dunnage to separate the containers and to hold shorter containers from movement. There also exists collars formed for maintaining bottles upright or in spaced fixed relationship in a shipping container. Further, there are the bifold inserts used to maintain articles in separated position for shipping and handling.

Examples of the packaging for bottles or cylindrical containers are found in U.S. Pat. Nos. 758,239 (1904), 2,563,132, 2,868,428; examples of containers for special articles are found in U.S. Pat. Nos. 2,706,590 and 4,291,803; and examples of special folded inserts for packages are U.S. Pat. Nos. 3,101,166 and 3,921,890. Shipping and display cartons use special inserts or fillers to provide a nice neat appearing package, for example see U.S. Pat. No. 1,443,216 for a shoe shine outfit with a filling member positioned to leave sufficient space for a plurality, in this instance, three receptacles of different polishes or cleaning materials. These are patents do not include the known shrink wrap containers where a plurality of gabletopped containers for oil or the like are placed in a flat, or shallow tray, formed of card or chip board or from corrugated board and overwrapped with a heat shrinkable film to hold the cartons on or in a package.

In any event the prior art does not suggest a carton for two part products which come in an A and a B container, of the gabletop variety, wherein the pair of primary containers are nested and held by a ridge piece shaped to fit on the double peaks of the gabletop containers of the pair. The ridge piece is adapted to divert ridge force to the gables which are better able to stand the shipping trauma than the sealing ridge; has a legend informing the user that it guards a single kit of a multi pack; permits direct view of the protected containers and their identification, and when removed, it exposes a single pair of containers, an A and a B. The piece is adapted for use in a multi-pair carton and restricts the possibility of mix-up or improper use of the ingredients of the multiple containers.

SUMMARY OF THE INVENTION

The present invention relates to an improved shipping and handling carton for a plurality of pairs of containers. The box or package of the present invention comprises a plurality of gabletopped containers, a carton for the containers, means in the carton for nesting the containers in pairs within the carton, with the gabletops all at one side, and individual identification pieces of material positioned at said one side to engage the gable tops of each pair of containers in each nested area for identification of the pairs of containers. The individual identification pieces comprise a bridge section spanning the nest area and a leaf section to accept a label or other form of indicia. The bridge section is doubly deeply grooved to receive the ridge seals and gable tops of the containers and comprises two pairs of gable contacting surfaces separated by recesses for receiving the ridge seals. The gable contacting surfaces of each pair are shaped to converge toward the recess for receiving the ridge seal.

The carton comprises a bottom and four side walls and flaps hinged to the side walls to form a top. Inside the side walls is positioned at least one partition to divide the interior of the carton into a plurality of areas each of sufficient space to receive a pair of gabletop containers. In the preferred container, a protective wall is spaced inwardly of the side walls and a plurality of interlocking wall members span the area within the protective wall and interlock therewith to space it from the side walls to define a plurality of nest areas for containers having their gabletops adjacent the top side of the carton.

BRIEF DESCRIPTION OF THE DRAWING

The present invention will be further described with reference to the accompanying drawing, wherein.

DETAILED DESCRIPTION OF THE PREFERRED EMBODIMENT

Figure 1:
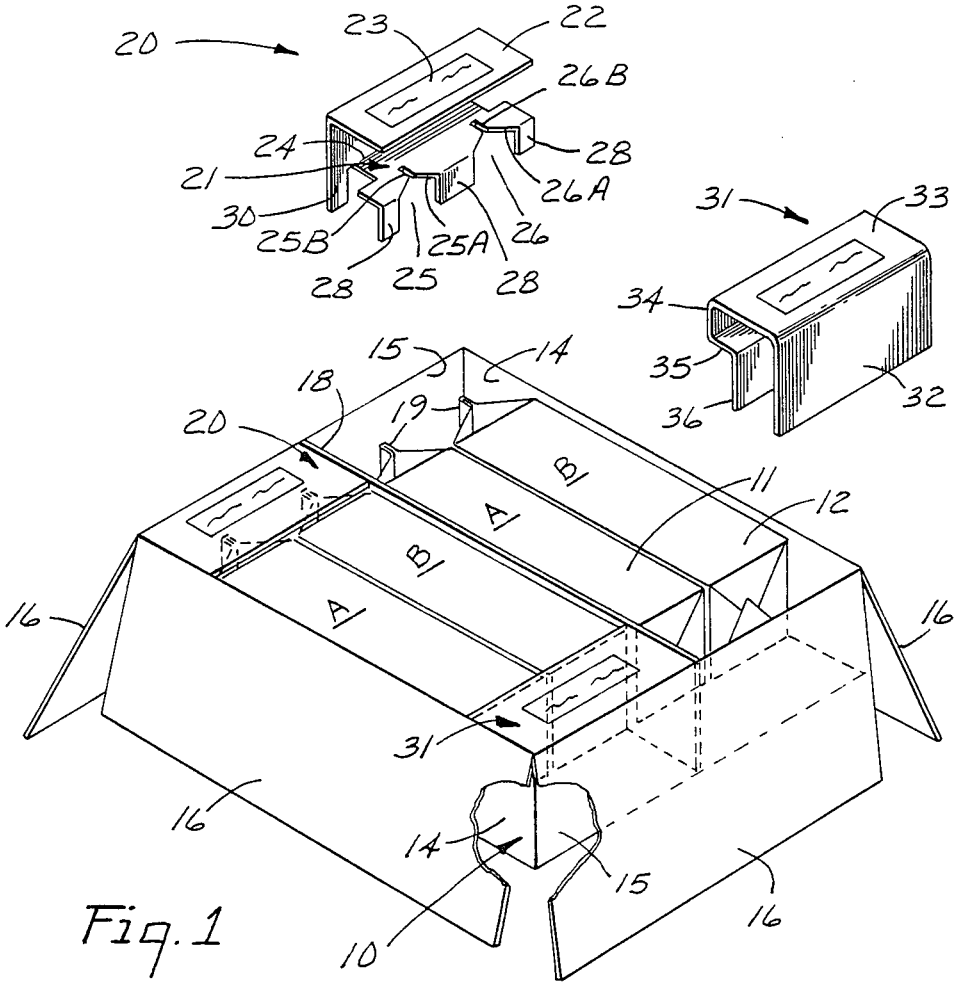
FIG. 1 is a perspective partially exploded view of a carton according to the present invention including the gabletop container protective and pair identifying piece.

Referring now to the drawing the invention will be described with reference to the embodiments illustrated. In the description like reference numerals will refer to like parts throughout the several views.

FIG. 1 illustrates a shipping and handling carton 10 adapted to contain a plurality of pairs of gabletop primary containers, each pair comprising a container A 11 containing a first compound adapted to be mixed with the contents of a second container B 12. The carton 10 comprises six sides, a bottom, four side walls, two longitudinal side walls 14 and two end walls 15, and a top. Each of the side walls have a flap 16 hinged thereto at a foldline, to form the top. The exact manner of closing the carton by flaps may vary. A partition 18 extends the length of the interior of the carton to divide the same into a plurality of nest areas each of which has sufficient space to receive a pair of the gabletop containers containing the desired quantity of material, which when removed from the carton and mixed together form a composition for use in filling a splice closure. Each container 11 and each container 12 are constructed in a manner well known in the art and have a gabletop terminating in a ridge seal 19 which top may be opened at one end of the ridge seal to obtain access to the contents. Normal opening of the container produces a pouring spout for dispensing the contents of the container. The fact that one container 11 together with one container 12 contain the ingredients of the filling compound make it necessary to restrict the possibility of error and the use of two containers of the composition of container 11 or of container 12. This can happen if the containers are shipped separately or the containers are separated in the box, i.e. with containers 11 on one side and containers 12 on the other side of the box, or each in a separate isolated area such as the bottles in a honeycomb in a case.

The gabletop container protective and pair identifying piece 20 is formed from a sheet of packaging material, such as pasteboard, and comprises a bridge section 21 for spanning the nest area of a pair of containers and contacting the gabletops of the two containers and a leaf or leaf section 22 for accepting a label or other form of indicia, such as a printed message 23 identifying a pair of containers. The bridge section 21 comprises a piece joined by at least one fold line 24 to the leaf section 22. The bridge section is doubly deeply grooved defining a pair of gable contacting portions 25 and 26, each having converging gable contacting surfaces **25*a* and 26*a* respectively, separated by a recess 25*b* and 26*b* formed to receive the sealed ridge of one of the gabletop containers. As illustrated in FIG. 1, tabs 28 are formed at the ends of the piece opposite a fold line 24 and are disposed to position the ridge contacting piece from the bottom of the carton 10. Legs 30 at each side of the bridge piece 21** also support the bridge piece from the bottom.

Optionally, a separate spacer 31 can be positioned between the bottom wall of the containers and the adjacent side of the carton. The spacer 31 is formed preferably of pasteboard and comprises a first leg portion 32, a label bearing bracing wall 33, a container support wall 34, an angled portion 35, and a second leg 36. This spacer positioned in each area for a pair of containers position the containers from the side 15.

Figure 2:
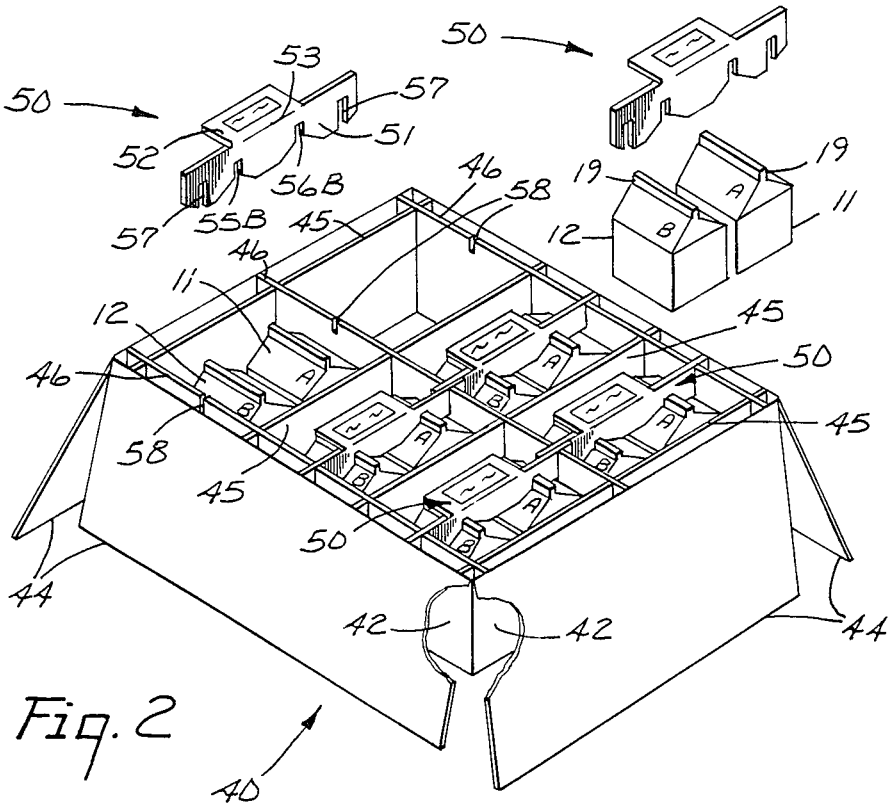
FIG. 2 is a perspective partially exploded view of a second embodiment of the invention.
Figure 3:
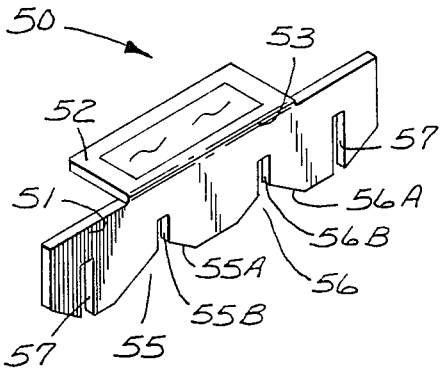
FIG. 3 is a perspective view of one embodiment of the identifying piece.

A second embodiment of a carton, is the carton 40 of FIGS. 2 and 3. The carton 40 comprises a plurality of pairs of gabletop containers, each pair comprising a container A 11 and a second container B 12, and a carton comprising six sides, i.e. a bottom wall (not shown), four side walls 42 and flaps or closure members 44 forming a top. The flaps illustrated are joined by fold lines to the side walls 42. The interior of the carton is divided into nest areas for pairs of the containers, with a container 11 and a container 12 in each nest area. The nest areas are defined by dividers 45 extending lengthwise of the carton and partitions 46 extending transversely and interlocking with the dividers 45 by the customary slots at the areas of intersection. In the illustrated carton the nests for six pairs of containers does not fill the entire cavity of the carton and there is a space formed between each of the nests and the side walls for added container protection with the extended ends of the dividers and partitions forming absorbing members for taking shock applied against the sides. The nests or compartments have an area sufficient to receive the two containers 11 and 12 and an identification piece 50 is positioned to identify each pair of containers. The containers may be the pint, quart or half gallon size.

The gabletop container protective and pair identification piece 50 is formed of pasteboard and comprises a bridge section 51 which spans the individual nest areas and a leaf section 52 for accepting a label or other indicia identifying the pair of containers in each area. The bridge section 51 is joined by at least one fold line 53 to the leaf section 52. The piece 50 is a doubly deeply grooved plate forming a pair of gable contacting portions 55 and 56, each groove having a pair of gable contacting surfaces **55*a* and 56*a*, respectively, separated by a recess 55*b* and 56*b* respectively formed to receive the sealed ridge of one of the containers. Adjacent each end of the bridge section 51 is a slotted opening 57 cooperating with slots 58 in the partitions 46** for supporting and positioning the identification pieces over each nest area.

Figure 4:
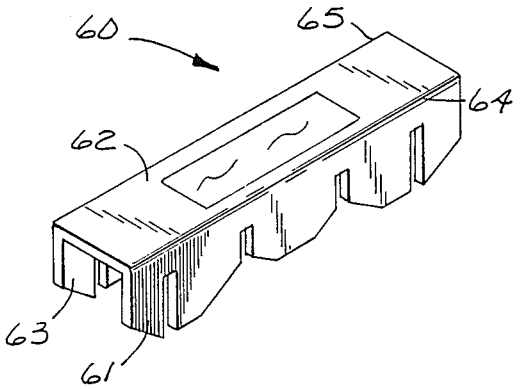
FIG. 4 is a perspective view of a second embodiment of the identifying piece for use with the carton of FIG. 2.

An alternative embodiment of the identification piece for the box 40 is shown in FIG. 4. This identification piece 60 comprises a bridge section 61, a leaf section 62 and a second bridge section 63. The bridge sections 61 and 63 are joined by fold lines 64 and 65 to the leaf section 62, respectively and each has a pair grooves defining gable contacting portions having gable contacting surfaces converging toward a sealed ridge receiving recess. The two bridge sections each have slots corresponding to the slots 57 in the plate 51, see FIG. 3, and additional slots 58 would have to be formed in the partitions 46 to properly position the pieces 60.

Figure 5:
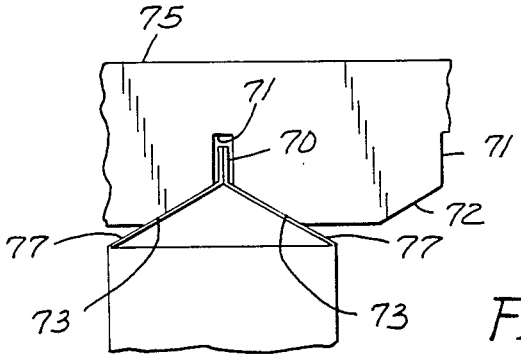
FIG. 5 is an enlarged fragmentary detail view of an identifying piece fitted to a gabletop container.

FIG. 5 illustrates the support position of a bridge plate 21, 51, 61 or 63 on a gabletop container. The ridge seal 70 is received in a recess 71 disposed between two converging gable contacting surfaces 72 and 73. The space between the end of the recess 71 and the fold line 75 of the bridge section gives strength to bridge section and the recess 71 is deeper than the height of the ridge seal 70 to allow the gable contacting surfaces 72 and 73 to rest on the gable areas 77 of the container.

Closing the top of the carton maintains the pieces, e.g. 20, 50 or 60 in place and the same serve to protect the gable ends of the containers and to clearly and distinctly identify the pairs of containers that are to be combined to form a resulting cable splice composition.

Having described the present invention with reference to the preferred embodiments, it will be understood that modifications may be made therein without departing from the scope of the present invention as defined in the appended claims.

I claim:

1. A shipping carton for a plurality of gabletopped containers containing compositions that are to be mixed, i.e. the contents of one container with the contents of another container, and the containers are provided in the carton in an equal number of the containers of each composition, said shipping carton comprising:

a plurality of containers with gabletops including a plurality of containers of a first composition and a plurality of containers of a second composition, a rigid carton having wall means defining a cavity and flap means connected to said wall means for closing said cavity, dividing means for dividing said carton cavity into areas for nesting pairs of said containers with a container having a first composition and a container having a second composition in each said area, and support means for supporting the gable tops of said containers in each area.

2. A shipping carton according to claim 1 wherein said support means comprises a folded piece of pasteboard having a pair of sides with one side being deeply doubly grooved to receive in said grooves the gable tops of two juxtapositioned containers.

3. A shipping carton according to claim 2 wherein said folded piece has indicia on one side thereof identifying a said pair of containers as being of a compatible material to be mixed.

4. A shipping carton according to claim 1 wherein said dividing means comprises a plurality of intersecting sheets of pasteboard formed with slotted openings to cooperate with each other to divide said cavity into a plurality of rectangular areas.

5. A shipping carton according to claim 4 wherein said dividing means separate said nesting areas from said wall means of said carton for defining an open space therebetween.

6. A shipping carton according to claim 4 wherein said support means bridge each said area by joining two said sheets forming a said area.

7. A shipping carton according to claim 5 wherein said support means comprises a folded piece of pasteboard having a pair of sides with one side forming a deeply doubly grooved plate to receive in said grooves the gable tops of two juxtapositioned containers.

8. A shipping carton according to claim 2 wherein filler means is disposed in a nesting area at the end of said containers opposite said gabletops.

9. A shipping carton according to claim 8 wherein indicia means is placed on one of said support means and said filler means for identifying said containers in each said area as a pair of containers, the contents of which are to be combined.

10. A shipping carton according to claim 1 wherein said support means comprises a sheet of pasteboard which is folded along a fold line separating said sheet into a pair of sides, one side being deeply doubly grooved to receive the gable tops of two juxtapositioned containers therein and having a slotted opening adjacent the ends of said one side to receive said dividing means for supporting said support means at opposite sides of a said nesting area.

11. A shipping carton according to claim 1 wherein said support means comprises a pair of spaced doubly deeply grooved plates spanning each of the areas of each pair of containers, each groove being formed to receive the gabled end of a said container, and leaf means joining said plates at the sides opposite the grooves to identify said areas.

* * * * *